US010253718B2

(12) United States Patent
Grime et al.

(10) Patent No.: US 10,253,718 B2
(45) Date of Patent: Apr. 9, 2019

(54) METHOD AND APPARATUS FOR CONTROLLING FUEL PRESSURE

(71) Applicant: GM GLOBAL TECHNOLOGY OPERATIONS LLC, Detroit, MI (US)

(72) Inventors: Thomas L. Grime, Toronto (CA); Yvan De Blois, Whitby (CA)

(73) Assignee: GM Global Technology Operations LLC, Detroit, MI (US)

( * ) Notice: Subject to any disclaimer, the term of this patent is extended or adjusted under 35 U.S.C. 154(b) by 76 days.

(21) Appl. No.: 15/359,766

(22) Filed: Nov. 23, 2016

(65) Prior Publication Data

US 2018/0142642 A1 May 24, 2018

(51) Int. Cl.

| | |
|---|---|
| ***F02D 41/30*** | (2006.01) |
| ***F02M 37/00*** | (2006.01) |
| ***F02M 37/08*** | (2006.01) |
| ***F02M 37/18*** | (2006.01) |
| ***F02M 55/02*** | (2006.01) |
| ***F02D 41/38*** | (2006.01) |
| *F02M 63/00* | (2006.01) |
| *F02D 41/14* | (2006.01) |

(52) U.S. Cl.

CPC ..... *F02D 41/3082* (2013.01); *F02D 41/3854* (2013.01); *F02M 37/0047* (2013.01); *F02M 37/08* (2013.01); *F02M 37/18* (2013.01); *F02M 55/025* (2013.01); *F02D 2041/141* (2013.01); *F02M 63/005* (2013.01)

(58) Field of Classification Search

CPC .. F02D 41/3082; F02M 37/18; F02M 63/005; F02M 63/025

See application file for complete search history.

(56) References Cited

U.S. PATENT DOCUMENTS

| | | | | |
|---|---|---|---|---|
| 5,505,180 A * | 4/1996 | Otterman | F02D 41/2464 | 123/497 |
| 5,715,797 A * | 2/1998 | Minagawa | F02D 41/3082 | 123/478 |
| 5,878,718 A * | 3/1999 | Rembold | F02D 33/006 | 123/198 D |
| 6,279,541 B1 * | 8/2001 | Doane | F02D 41/3082 | 123/497 |

(Continued)

FOREIGN PATENT DOCUMENTS

| | | |
|---|---|---|
| DE | 102010064176 A1 | 6/2012 |
| DE | 102011005663 A1 | 9/2012 |

*Primary Examiner* — Hung Q Nguyen
*Assistant Examiner* — Xiao En Mo
(74) *Attorney, Agent, or Firm* — Quinn IP Law

(57) ABSTRACT

An engine fuel system includes a fuel delivery system including a first fuel pump that is coupled to a pressure relief valve that is arranged in parallel with a second fuel pump. The first fuel pump is disposed to deliver pressurized fuel to the second fuel pump and the pressure relief valve, and the second fuel pump is disposed to deliver pressurized fuel to the fuel rail. A controller characterizes the first fuel pump to determine a relationship between a fuel pump speed and a fuel pump current at a setpoint pressure for the pressure relief valve. A feed-forward pump speed command is determined based upon a target fuel pressure and a fuel flowrate. A closed-loop pump speed is commanded based upon the characterization of the fuel pump. The first fuel pump is controlled to deliver fuel to the second fuel pump based thereon.

17 Claims, 4 Drawing Sheets

(56) References Cited

U.S. PATENT DOCUMENTS

| | | | | |
|---|---|---|---|---|
| 7,784,446 | B2 * | 8/2010 | Rumpf | F02D 41/221 123/497 |
| 8,707,932 | B1 * | 4/2014 | Marin | F02D 41/3082 123/479 |
| 9,528,519 | B2 * | 12/2016 | Sausner | F02D 41/221 |
| 9,885,310 | B2 * | 2/2018 | Pursifull | F02M 63/0265 |
| 2003/0136376 | A1 * | 7/2003 | Tachibana | F01L 1/344 123/396 |
| 2013/0166482 | A1 * | 6/2013 | Veit | F02D 41/1402 706/12 |
| 2014/0105758 | A1 * | 4/2014 | Sausner | F02D 41/221 417/44.11 |
| 2015/0275816 | A1 * | 10/2015 | Pursifull | F02D 41/3094 123/456 |
| 2016/0025030 | A1 * | 1/2016 | Ulrey | F02D 41/3854 123/294 |
| 2016/0208757 | A1 * | 7/2016 | Pursifull | F02M 59/022 |

* cited by examiner

METHOD AND APPARATUS FOR CONTROLLING FUEL PRESSURE

INTRODUCTION

Some internal combustion engines employ direct fuel-injection systems to supply fuel through fuel injectors via a fuel system that includes a fuel pump, fuel lines and a fuel rail, wherein a fuel pressure sensor is disposed to monitor fuel pressure. Control of fuel pressure that is delivered to the fuel rail and injectors may be accomplished employing a closed-loop system that controls operation of the fuel pump based upon signal feedback from the fuel pressure sensor.

SUMMARY

A fuel system for an internal combustion engine is described, and includes a fuel delivery system including a first fuel pump that is fluidly coupled to a pressure relief valve that is fluidly disposed in parallel with a second fuel pump. The first fuel pump is disposed to deliver pressurized fuel to the second fuel pump and the pressure relief valve, and the second fuel pump is disposed to deliver pressurized fuel to the fuel rail. A controller is operatively connected to the first fuel pump and the internal combustion engine and includes an instruction set. The instruction set is executable to characterize the first fuel pump to determine a relationship between a fuel pump speed and a fuel pump current at a setpoint pressure for the pressure relief valve. A target fuel pressure and a fuel flowrate, are determined, and a feed-forward pump speed command is determined based thereon. A closed-loop pump speed is commanded based upon the target fuel pressure, the fuel flowrate and the characterization of the fuel pump. Operation of the first fuel pump is controlled to deliver fuel to the second fuel pump based upon the feed-forward pump speed command and the closed-loop pump speed command.

An aspect of the concepts described herein includes the fuel delivery system being configured absent a fuel pressure sensor.

Another of the concepts described herein includes the first fuel pump being a positive-displacement fuel pumping element rotatably coupled to a multi-phase electric motor.

Another of the concepts described herein includes the controller including a fuel pump controller disposed to control the multi-phase electric motor in response to the feed-forward pump speed command and disposed to determine the closed-loop pump speed command.

Another of the concepts described herein includes the fuel pump controller disposed to determine a magnitude of electric current that is delivered to the electric motor and the fuel pump speed.

Another of the concepts described herein includes the second fuel pump that is fluidly arranged in parallel with the pressure relief valve.

Another of the concepts described herein includes the instruction set executable to control the electric motor of the first fuel pump to cause the positive-displacement pumping element to operate at a final pump speed command to controllably deliver fuel to the high-pressure fuel pump at the desired pressure.

Another of the concepts described herein includes the instruction set being executable to intrusively characterize the fuel pump to determine a relationship between the fuel pump speed and the fuel pump current at the setpoint pressure of the fuel system pressure relief valve.

Another of the concepts described herein includes the instruction set being executable to characterize the fuel pump to determine a relationship between a fuel pump speed and a fuel pump current at the setpoint pressure of the fuel system pressure relief valve by commanding an increase in the fuel pump speed and monitor the fuel pump current, and determining a point of inflection in the fuel pump current and an associated fuel pump speed.

Another of the concepts described herein includes subjecting the fuel pump current to dual low pass filtering to detect the point of inflection of the fuel pump current.

Another of the concepts described herein includes a method to control operation of the fuel system described herein.

The above features and advantages, and other features and advantages, of the present teachings are readily apparent from the following detailed description of some of the best modes and other embodiments for carrying out the present teachings, as defined in the appended claims, when taken in connection with the accompanying drawings.

BRIEF DESCRIPTION OF THE DRAWINGS

One or more embodiments will now be described, by way of example, with reference to the accompanying drawings, in which.

DETAILED DESCRIPTION

The components of the disclosed embodiments, as described and illustrated herein, may be arranged and designed in a variety of different configurations. Thus, the following detailed description is not intended to limit the scope of the disclosure, as claimed, but is merely representative of possible embodiments thereof. In addition, while numerous specific details are set forth in the following description in order to provide a thorough understanding of the embodiments disclosed herein, some embodiments can be practiced without some or all of these details. Furthermore, the disclosure, as illustrated and described herein, may be practiced in the absence of an element that is not specifically disclosed herein. Moreover, for the purpose of clarity, certain technical material in the related art has not been described in detail in order to avoid unnecessarily obscuring the disclosure. Furthermore, the drawings are in simplified form and are not to precise scale. As employed herein, the term "upstream" and related terms refer to elements that are towards an origination of a flow stream relative to an indicated location, and the term "downstream" and related terms refer to elements that are away from an origination of a flow stream relative to an indicated location.

Figure 1:
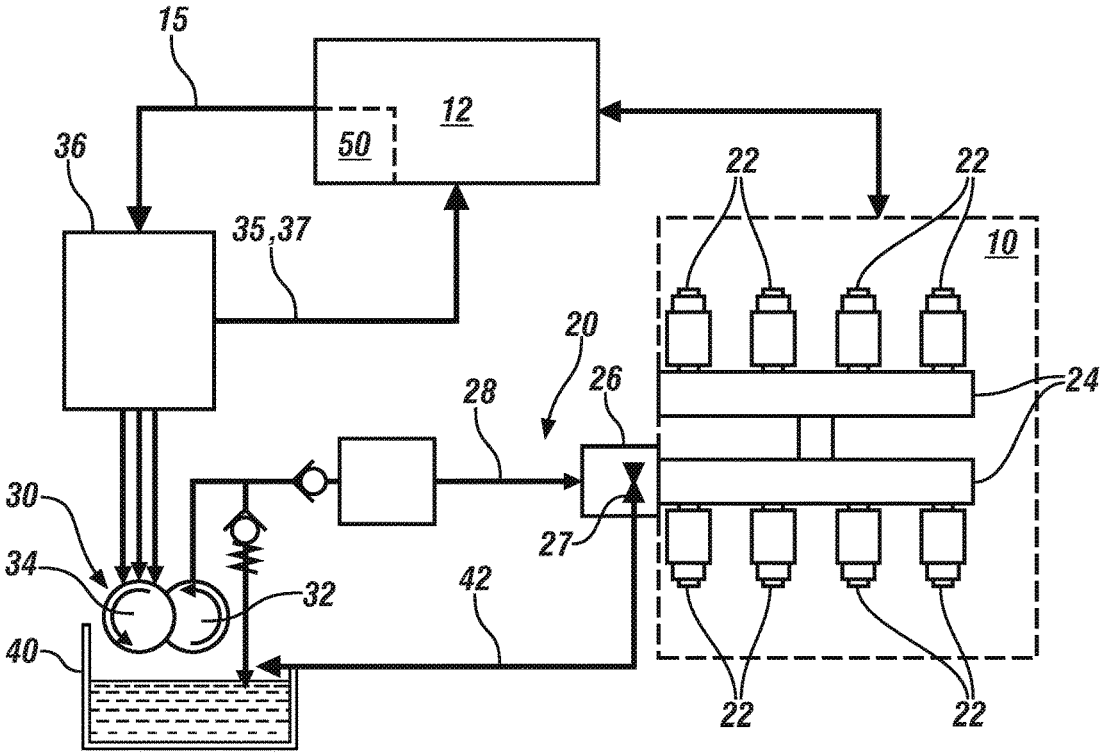
FIG. 1 schematically illustrates a fuel delivery system for an internal combustion engine that is controlled by a controller, in accordance with the disclosure.

Referring to the drawings, wherein like reference numerals correspond to like or similar components throughout the several Figures, FIG. 1 illustrates an embodiment of a fuel delivery system 20 for an internal combustion engine (engine) 10 that may be disposed to supply tractive power in a vehicle. Operation of the fuel delivery system 20 and the engine 10 are preferably controlled by a controller 12 in response to operator commands and other factors. The vehicle may include, but not be limited to a mobile platform in the form of a commercial vehicle, industrial vehicle, agricultural vehicle, passenger vehicle, aircraft, watercraft, train, all-terrain vehicle, personal movement apparatus, robot and the like to accomplish the purposes of this disclosure.

The engine 10 may be a suitable internal combustion engine, and is configured as a direct-fuel-injection compression-ignition internal combustion engine in one embodiment. The fuel delivery system 20 is disposed to supply pressurized fuel to a fuel rail 24, which is fluidly connected to a plurality of fuel injectors 22 that are disposed to directly inject fuel into individual cylinders of the engine 10. In one embodiment, the fuel rail 24 is a common rail device.

The fuel delivery system 20 preferably includes a fuel tank 40, a first, low-pressure fuel pump 30 and an associated fuel pump controller 36, a second, high-pressure fuel pump 26 and an associated pressure relief valve 27 and other fluidic elements such as valves, couplings, fuel lines, etc. The pressure relief valve 27 is preferably fluidly arranged in parallel with the high-pressure fuel pump 26 to permit the pressure relief valve 27 to control maximum threshold pressure that is delivered to the high-pressure fuel pump 26. The terms "low-pressure" and "high-pressure" are relative in nature, and are intended to identify the relative pressures that they are capable of generating. The low-pressure fuel pump 30 may include a turbine-type pumping body, a gerotor pumping body, or another suitable pumping element that is disposed to draw fuel at low pressure from the fuel tank 40, which it supplies into a fuel line 28 at increased pressure for delivery via the pressure relief valve 27 to the high-pressure fuel pump 26. By way of a non-limiting example, pressure in the fuel line 28 may be in the order of magnitude of 400 kPa. The pressure in the fuel line 28 is controlled by control of the low-pressure fuel pump 30, in conjunction with the pressure relief valve 27. The high-pressure fuel pump 26 may be a cam-driven device in the form of a positive-displacement pump that receives low-pressure fuel from the low-pressure fuel pump 30 in one embodiment, for pressurizing to deliver to the fuel rail 24, with the magnitude of incoming pressure to the high-pressure fuel pump 26 being controlled by the pressure relief valve 27. By way of a non-limiting example, pressure of the fuel that is delivered to the fuel rail 24 may be in the order of magnitude of 200 MPa when the engine 10 is configured as a compression-ignition engine. Alternatively, the pressure of the fuel that is delivered to the fuel rail 24 may be in the order of magnitude of 20 MPa when the engine 10 is configured as a direct-injection spark-ignition engine. Specific fuel pressure levels are application-specific. The low-pressure fuel pump 26 and the high-pressure fuel pump 30 may be suitable devices that are configured to deliver pressurized fuel in the associated system, whether a compression-ignition engine, a direct-injection spark-ignition engine, or other.

The pressure relief valve 27 is preferably configured as a mechanical pressure regulator that is disposed in parallel with the high-pressure fuel pump 26 to protect against overpressure on the low-pressure inlet side of the high-pressure fuel pump 26. The pressure relief valve 27 preferably includes a low-pressure outlet that connects via a return line 42 to the fuel tank 40, and may be incorporated into an assembly that includes the high-pressure fuel pump 26. Neither the fuel delivery system 20 nor the low-pressure fuel pump 30 includes a fuel pressure sensor, and as such there is no direct measurement of fuel pressure in the fuel line 28 that is provided as feedback to the controller 12 to effect control of the low-pressure fuel pump 30. When the incoming pressure to the high-pressure fuel pump 26 is greater than its setpoint pressure, the mechanical regulator of the pressure relief valve 27 opens and passes low-pressure fuel into the return fuel line 42 back to the fuel tank 40. Furthermore, some low pressure fuel leaks through internal channels in the high-pressure fuel pump 26 to the fuel tank 40 via the return line 42 to provide cooling and lubrication of the high-pressure fuel pump 26. Fuel pressure in the fuel rail 24 is controlled via operation of the high-pressure fuel pump 26.

The low-pressure fuel pump 30 includes a pumping element 32 that is coupled to and driven by an electric motor 34. The pumping element 32 may be configured as a positive-displacement pumping element 32 in one embodiment, and may be a gerotor configuration, a radial-piston configuration, or another suitable device capable of fluidic pumping. The electric motor 34 may be a brushless multiphase electric motor that is electrically connected to and operatively controlled by the fuel pump controller 36, or alternatively, another suitable electric motor. The fuel pump controller 36 includes circuitry that is capable of controlling operation of the electric motor 34 in response to a commanded pump speed 15. The fuel pump controller 36 also includes circuitry that is capable of determining a magnitude of electrical current 35 that is delivered to the electric motor 34 and a pump rotational speed 37, which may be communicated to the controller 12.

The pressure relief valve 27 may be a suitable mechanical pressure regulator and pressure relief device, and may include a valve element that is urged against a valve seat by a valve spring, wherein the magnitude of force exerted by the valve spring on the ball valve against the valve seat is calibrated such that there is no flow through its low pressure outlet to the return line 42 until the fuel pressure from the low-pressure fuel pump 30 into the fuel line 28 is greater than the maximum threshold pressure, i.e. its setpoint pressure. The setpoint pressure corresponds to a desired pressure for delivery to the high-pressure fuel pump 26.

The high-pressure fuel pump 26 preferably includes a positive-displacement pumping element that is mechanically coupled to and driven by a mechanical cam device. The positive-displacement pumping element may be a gerotor configuration, a radial-piston configuration, or another suitable device capable of high-pressure positive-displacement fluidic pumping.

The controller 12 is disposed to control operation of the fuel delivery system 20 and the internal combustion engine 10 in response to operator commands and other factors. The controller 12 preferably includes a fuel pump control routine 50 that is executable to control the electric motor 34 of the low-pressure fuel pump 30 to cause the positive-displacement pumping element 32 to operate at a final pump speed command 15 to controllably deliver fuel to the high-pressure fuel pump 26, which in turn pumps fuel through the fuel rail 24 and the fuel injectors 22 to the engine 10 at a desired fuel rail pressure. Details related to the fuel pump control routine 50 are described with reference to FIG. 2.

The controller 12 is depicted as a unitary device for ease of illustration and description. The controller 12 may be embodied in a plurality of controllers that are disposed to execute various functions in a distributed controller environment. The terms controller, control module, module, control, control unit, processor and similar terms refer to one or various combinations of Application Specific Integrated Circuit(s) (ASIC), electronic circuit(s), central processing unit(s), e.g., microprocessor(s) and associated non-transitory memory components in the form of memory and storage devices (read only, programmable read only, random access, hard drive, etc.). The non-transitory memory components are capable of storing machine readable instructions in the form of one or more software or firmware programs or routines, combinational logic circuit(s), input/output circuit (s) and devices, signal conditioning and buffer circuitry and other components that can be accessed by one or more processors to provide a described functionality. Input/output circuit(s) and devices include analog/digital converters and related devices that monitor inputs from sensors, with such inputs monitored at a preset sampling frequency or in response to a triggering event. Software, firmware, programs, instructions, routines, control routines, code, algorithms and similar terms mean controller-executable instruction sets including calibrations and look-up tables. Each controller executes routine(s) to provide desired functions, including monitoring inputs from sensing devices and other networked controllers and executing control and diagnostic instructions to control operation of actuators. Routines may be executed at regular intervals, for example each 100 microseconds during ongoing operation. Alternatively, routines may be executed in response to occurrence of a triggering event. Communication between controllers, and communication between controllers, actuators and/or sensors may be accomplished using a direct wired point-to-point link, a networked communication bus link, a wireless link or another suitable communication link. Communication includes exchanging data signals in a suitable form, including, for example, electrical signals via a conductive medium, electromagnetic signals via air, optical signals via optical waveguides, and the like. The data signals may include discrete, analog or digitized analog signals representing inputs from sensors, actuator commands, and communication between controllers. The term "signal" refers to a physically discernible indicator that conveys information, and may be a suitable waveform (e.g., electrical, optical, magnetic, mechanical or electromagnetic), such as DC, AC, sinusoidal-wave, triangular-wave, square-wave, vibration, and the like, that is capable of traveling through a medium. As used herein, the terms 'dynamic' and 'dynamically' describe steps or processes that are executed in real-time and are characterized by monitoring or otherwise determining states of parameters and regularly or periodically updating the states of the parameters during execution of a routine or between iterations of execution of the routine.

Figure 2:
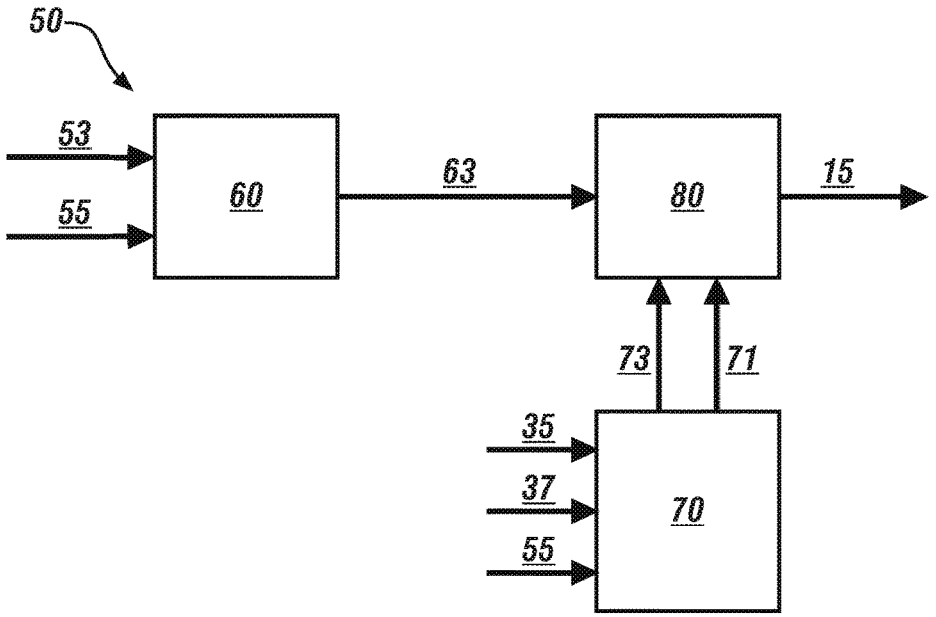
FIG. 2 schematically illustrates a fuel pump control routine that executes to control an electric motor of a fuel pump to cause a pumping element to operate at a final pump speed command to controllably deliver fuel through a fuel rail and fuel injectors to the engine at a desired pressure, in accordance with the disclosure.

FIG. 2 schematically shows an embodiment of the fuel pump control routine 50 that executes to advantageously control the electric motor 34 of the low-pressure fuel pump 30 to cause the positive-displacement pumping element 32 to operate at a final pump speed command 15 to controllably deliver fuel to the high-pressure fuel pump 26 at the desired pressure. The fuel pump control routine 50 may be in the form of hardware, software, and/or firmware components that can be executed in and through the controller 12 to advantageously control the electric motor 34 of the low-pressure fuel pump 30 without employing a fuel line pressure sensor to monitor the fuel pressure. The fuel pump control routine 50 facilitates estimation of fuel system pressure without employing a fuel pressure sensor, which includes employing techniques to robustly detect a deviation in the fuel pump current in relation to fuel pump speed, which may in turn be correlated to the setpoint pressure of the pressure relief valve 27. Such a configuration enables sensor-less fuel pressure control. As employed herein, the term "fuel system pressure" indicates the magnitude of fuel pressure in the fuel delivery system 20.

The fuel pump control routine 50 determines the final pump speed command 15 employing a feed-forward pump speed determination routine 60, a fuel pump characterization routine 70 and a pump speed correction routine 80.

The feed-forward pump speed determination routine 60 determines an open-loop pump speed command 63 based upon a fuel system target pressure 53 and a fuel flow demand 55. The fuel flow demand 55 may be determined based upon an operator request for power and other factors related to supplying fuel to the engine 10 to meet the demanded power output from the engine 10, and the fuel system target pressure 53 is preferably a pre-set pressure that is at or below the setpoint pressure of the pressure relief valve 27. The open-loop pump speed command 63 is the commanded pump speed to achieve the fuel flow demand 55 at the fuel system target pressure 53, based upon the capacity of the low-pressure fuel pump 30 and the configuration of the engine 10. The open-loop pump speed command 63 for a fuel system target pressure 53 and a fuel flow demand 55 may be in the form of a predetermined calibration that is stored in a non-volatile memory device as an executable relationship, a look-up table, or another suitable format. The relationship between the open-loop pump speed command 63, the fuel flow demand 55 and the fuel system target pressure 53 may be developed during engine development, and/or may be updated during engine operation. Furthermore, the relationship between the open-loop pump speed command 63, the fuel flow demand 55 and the fuel system target pressure 53 may be adjusted based upon other factors that may be monitored or otherwise determined during engine operation, such as temperature.

The fuel pump characterization routine 70 is executed to determine a relationship between a fuel pump speed 37 and fuel pump current 35, which indicates fuel system pressure during operation of an embodiment of the engine 10 that is described with reference to FIG. 1. The fuel pump characterization routine 70 infers fuel system pressure when the pressure relief valve 27 opens. This information can be employed in the fuel pump control routine 50 to control the fuel delivery system 20 to control fuel pressure to a desired level based upon the magnitude of the pump current that is associated with opening of the pressure relief valve 27, i.e. at its setpoint pressure.

The fuel pump characterization routine 70 includes inputs of the fuel pump speed 37, fuel pump current 35 and the fuel flow demand 55. The fuel delivery system 20 is commanded to ramp up the fuel pump speed 37 in a step-wise manner and monitor the pump current 35. The pump current 35 is monitored and evaluated to detect an inflection point, which can be associated with operating conditions that occur when the fuel system pressure exceeds the setpoint pressure for the pressure relief valve 27. At this point, the fuel system pressure can urge the pressure relief valve 27 to open, thus allowing a portion of the pressurized fuel to bypass to the return line 42 while maintaining the fuel pressure at an inlet to the high-pressure fuel pump 26 at the setpoint pressure. Outputs from the fuel pump characterization routine 70 include a magnitude of fuel pump speed 71 and a corresponding fuel flowrate 73 at the inflection point in the fuel pump current.

Figure 3:
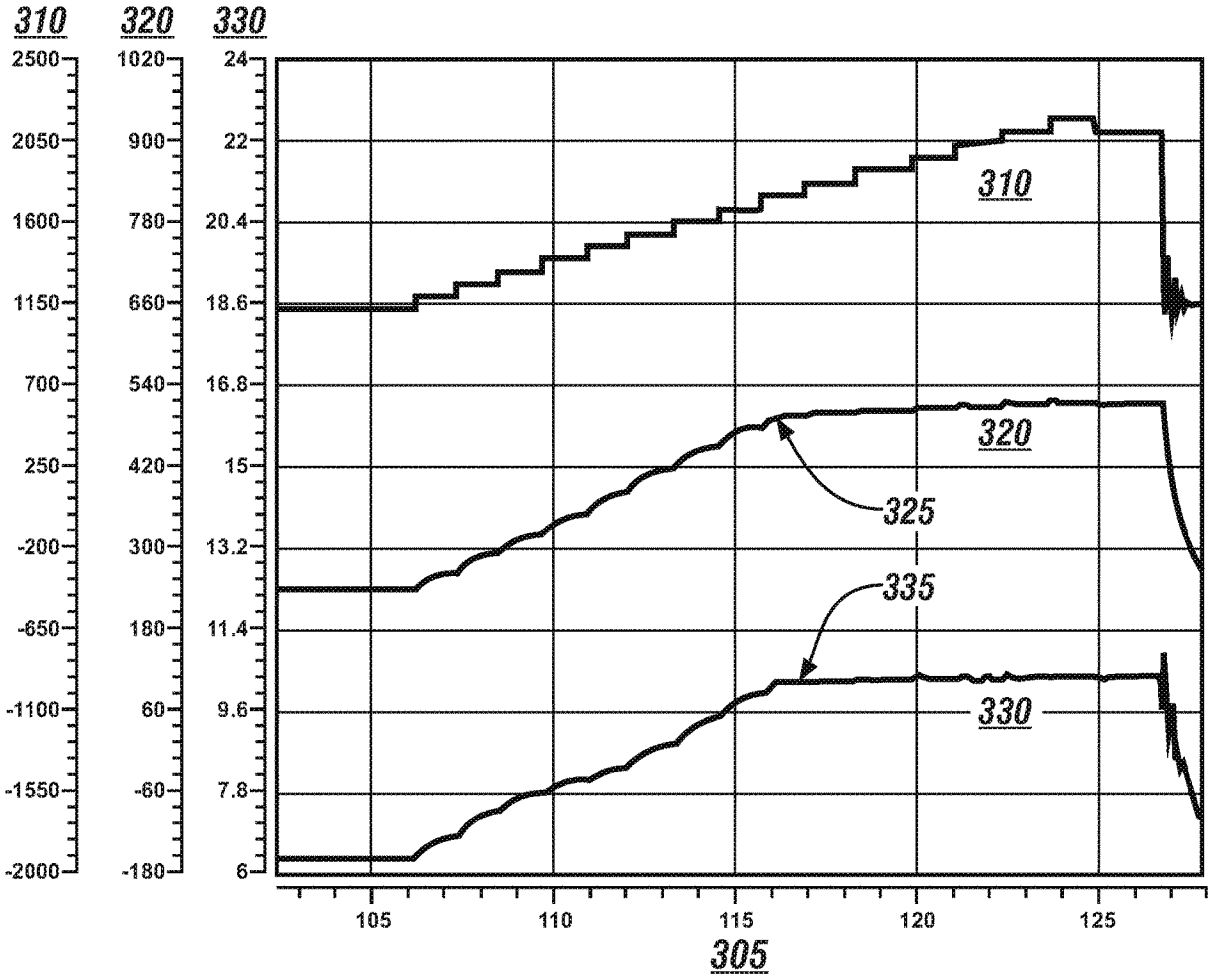
FIG. 3 graphically shows data associated with a commanded fuel pump speed, a fuel system pressure and fuel pump current for an embodiment of the fuel delivery system described with reference to FIG. 1, wherein the data indicates a relationship between the fuel pump current and a fuel pressure inflection point that corresponds to a setpoint pressure that is associated with fluidic opening of a pressure relief valve that is disposed in the fuel delivery system, in accordance with the disclosure.

The inflection point in the fuel pump current can be detected by employing signal processing and analytical routines, and indicates a change in the relation between the fuel pump speed and the fuel pressure in the fuel line 28. By observing changes in parameters such as fuel flow and pump speed at the inflection point, the system can be calibrated to detect and compensate for fuel system anomalies, such as fuel filter blockage, fuel line leakage, pump wear, and part-to-part variation. The pump flowrate is indicated by pump speed, and the pressure is indicated by pump current, at operating points that are less than the point of inflection, and the inflection point between the commanded fuel pump speed and the fuel pump current indicates opening of the pressure relief valve 27. This is described with reference to FIG. 3. In one embodiment, the fuel pump characterization routine 70 may be executed intrusively during real-time operation of the engine 10. The fuel pump characterization routine 70 executes intrusively execution of the characteristic FIG. 3 graphically shows data including a commanded fuel pump speed 310, a fuel system pressure 320 and fuel pump current 330, all in relation to time 305, which is shown on the horizontal axis, wherein the data is associated with operation of an embodiment of the fuel delivery system 20 described with reference to FIG. 1. The data indicates a relationship between the fuel pump current 330 and a fuel pressure inflection point 325 that corresponds to opening of the pressure relief valve 27 that is incorporated into the fuel delivery system 20, as described with reference to FIG. 2. This relationship can be advantageously employed as part of the fuel pump characterization routine 70 that is described with reference to FIG. 2. As indicated, the commanded fuel pump speed 310 and the fuel pump current 320 increase with an increase in the fuel system pressure 330 at system pressures that are less than the pressure inflection point 325. The fuel pump current 330 exhibits a current inflection point 335 at the pressure inflection point 325, which corresponds to the inflection point that indicates opening of the pressure relief valve 27. The inflection point as indicated by the pressure inflection point 325 is a point at which the relationship between fuel system pressure 320 and the fuel pump speed 310 deviate. The fuel pump characterization routine 70 can be employed to develop a relationship between the fuel system pressure 320, which is determined at the pressure inflection point 325, and the current inflection point 335 for the fuel pump current 330, which can be measured during operation of the low-pressure fuel pump 30.

One process to determine the current inflection point 335 that indicates the inflection point in the fuel pump current in relation to fuel pump speed may include executing routines that incorporate one or a combination of three analytical techniques to analyze fuel pump current data. The analytical techniques include executing dual low pass filtering, determining peak and pit differences in filtered difference of fuel pump currents, and confirming a rate of change in the current difference. As employed herein, the term "filter" and related terms refer to electronic processing of data signals to attenuate portions of a data signal and/or enhance other portions of a data signal, employing analog devices, digital devices and/or software routines.

Executing dual low pass filtering includes subjecting the fuel pump current 330 to a first low pass filter having a large time constant and simultaneously subjecting the fuel pump current 330 to a second low pass filter having a small time constant, and subtracting the resultant of the first low pass filter from the resultant of the second low pass filter. The difference can be divided by a difference between the large time constant and the small time constant to determine a resultant. The resultant can be evaluated to detect the current inflection point 335, which is a point at which the difference between the resultant from the first low pass filter and the resultant from the second low pass filter is at a maximum or peak value. The dual low pass filtering identifies a deviation in the fuel pump current 330, thus permitting a control routine to detect a current inflection point 335 in the fuel pump current 330.

Figure 4:
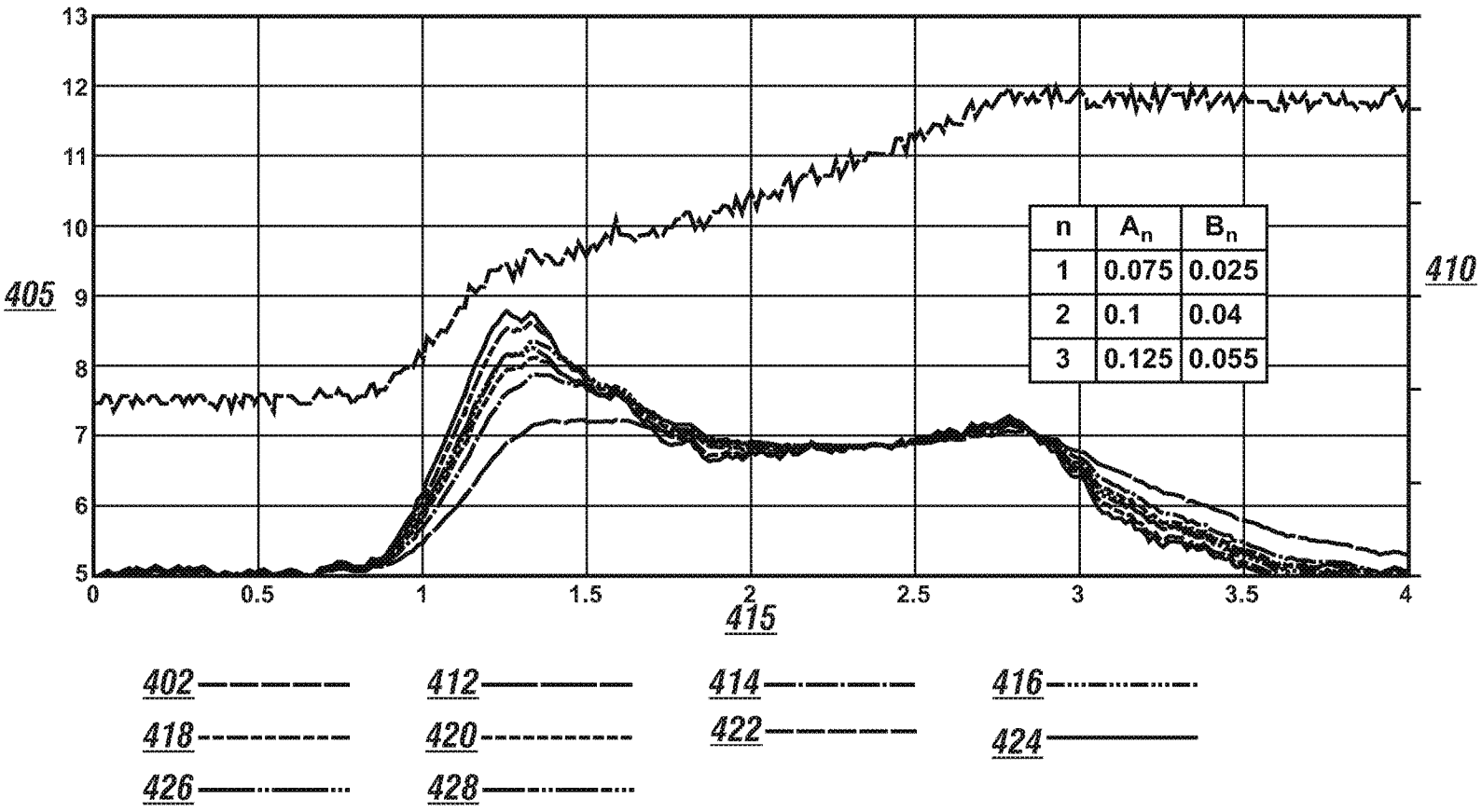
FIG. 4 graphically shows data associated with an unfiltered fuel pump current, and corresponding a plurality of filtered fuel pump currents, wherein current magnitude is indicated on the vertical axis and time is indicated on the horizontal axis, in accordance with the disclosure.

FIG. 4 graphically shows data associated with an unfiltered fuel pump current 402, and a corresponding data associated with a plurality of differences between filtered fuel pump currents 412, 414, 416, 418, 420, 422, 424, 426 and 428, wherein current magnitude 405 is indicated on the left vertical axis, current difference 410 is indicated on the right vertical axis and time 415 is indicated on the horizontal axis. The plurality of differences between the filtered fuel pump currents 412, 414, 416, 418, 420, 422, 424, 426 and 428 represent different combinations of first and second filtering coefficients $A_n$ and $B_n$, respectively, which are applied to the unfiltered fuel pump current 402 and have increasingly greater time constants, which provides some magnitude of separation. In one embodiment, the By way of non-limiting examples, the filtered fuel pump current difference 412 is associated with coefficients $A_1$ and $B_1$, the filtered fuel pump current difference 414 is associated with coefficients $A_1$ and $B_2$; the filtered fuel pump current difference 416 is associated with coefficients $A_1$ and $B_3$; the filtered fuel pump current difference 418 is associated with coefficients $A_2$ and $B_1$; the filtered fuel pump current difference 420 is associated with coefficients $A_2$ and $B_2$; the filtered fuel pump current difference 422 is associated with coefficients $A_2$ and $B_3$; the filtered fuel pump current difference 424 is associated with coefficients $A_3$ and $B_1$; the filtered fuel pump current difference 426 is associated with coefficients $A_3$ and $B_2$; and the filtered fuel pump current difference 428 is associated with coefficients $A_3$ and $B_3$. In one non-limiting example, the coefficients may be as follows:

| n | $A_n$ | $B_n$ |
|---|---|---|
| 1 | 0.075 | 0.025 |
| 2 | 0.1 | 0.04 |
| 3 | 0.125 | 0.055 |

The filtering coefficients are illustrative, and indicate one non-limiting example of an analysis method to determine preferred values for the filtering coefficients. This analysis can be employed in tuning the values for a large time constant and a small time constant for a dual low pass filtering routine to determine the deviation in the fuel pump current. The result can be evaluated to detect the current inflection point 335 described with reference to FIG. 3, which is a point at which the resultant difference between the large time constant and the small time constant is at a maximum or peak value.

Figure 5:
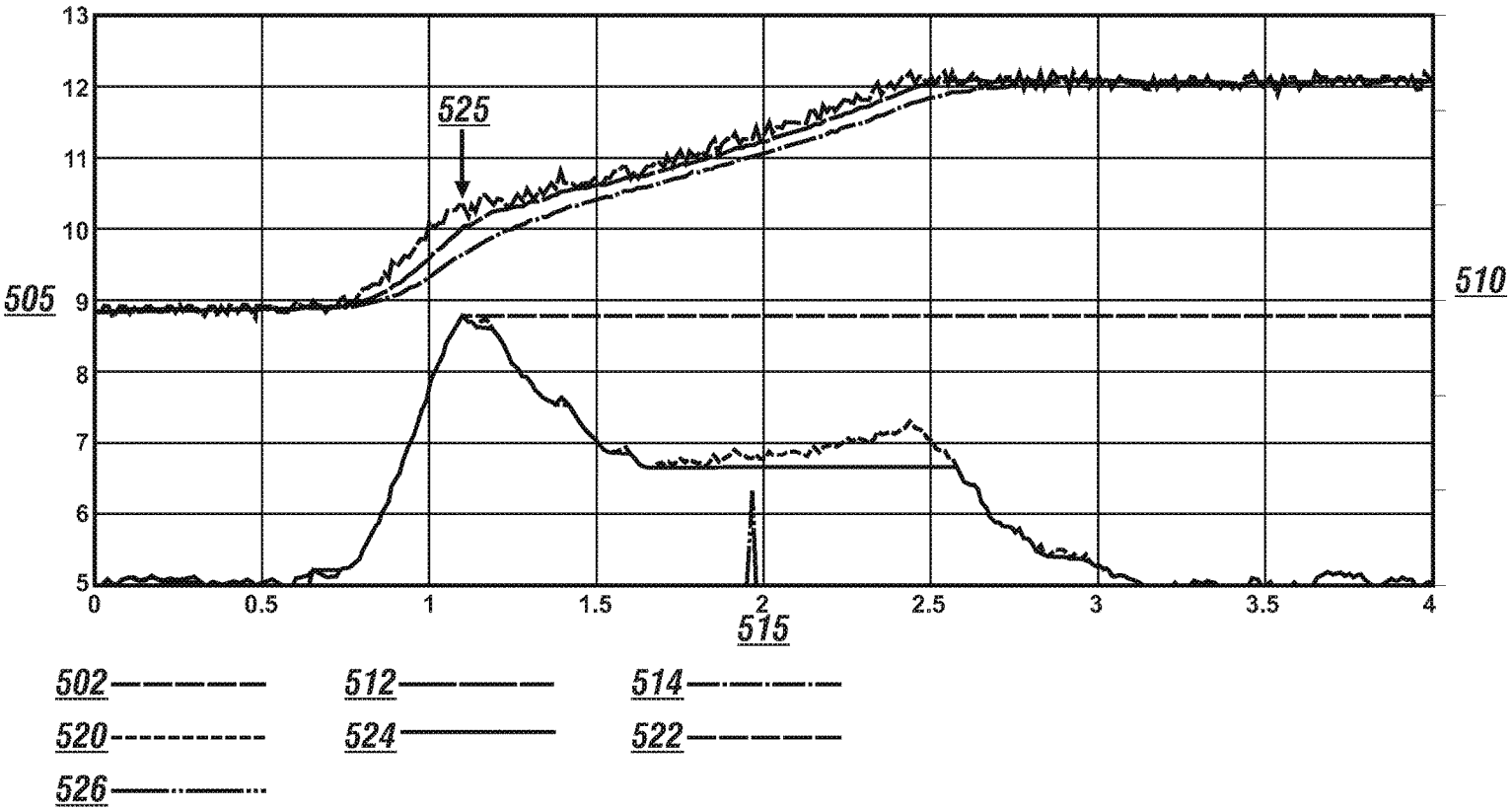
FIG. 5 graphically shows data associated with the unfiltered fuel pump current and corresponding first and second filtered fuel pump currents, with current magnitude indicated on the vertical axis in relation to time, which is indicated on the horizontal axis, in accordance with the disclosure.

FIG. 5 graphically shows data associated with the unfiltered fuel pump current 502, and corresponding first and second filtered fuel pump currents 512 and 514, wherein the first filtered fuel pump current 512 is associated with a filter having a time constant with a low value, and the second filtered fuel pump current 514 is associated with a filter having a time constant with a high value. Magnitude of the current 505 is indicated on the left vertical axis, magnitude of the filtered current difference 510 is indicated on the right vertical axis, and time 515 is indicated on the horizontal axis. A filtered current difference 520 is shown, which represents a calculated difference between the first and second filtered fuel pump currents 512 and 514. The filtered current difference 520 is equivalent to the filtered fuel pump current difference 424 that associated with coefficients $A_3$ and $B_1$ shown with reference to FIG. 4. A real-time peak value 522 for the filtered current difference 520 is also shown, along with a real-time pit value 524.

The filtered current difference 520 and the real-time peak value 522 are shown increasing to a current inflection point 525, which is a deviation in the fuel pump current that corresponds to opening of the pressure relief valve 27 in an embodiment of the fuel delivery system 20 described with reference to FIG. 1. The real-time pit value 524 indicates a minimum value for the current difference 520, and can be employed to verify the current inflection point 525. The deviation point estimate, i.e., the current inflection point 525 that is derived from the peak value 522 is verified based upon the pit value 524. The current inflection point 525 that is indicated by the filtered current difference 520 and a maximum state for the real-time peak value 522 can be employed to identify the opening of the pressure relief valve 27 that is described with reference to FIG. 1. As such, this information can be employed by the fuel pump control routine 50 to control the fuel delivery system 20. Determining a deviation in the fuel pump current 330, i.e., detecting when the fuel pump current 300 exhibits a current inflection point 335 may include subjecting the fuel pump current 300 to the dual low pass filtering routine in one embodiment. The deviation in the fuel pump current 330 is subsequently confirmed 526 based upon the current difference 520 and the real-time pit value 524.

Referring again to FIG. 2, the pump speed correction routine 80 employs the fuel pump speed 71 and fuel pump flowrate 73 that are associated with the current inflection point 335 to compensate the open-loop pump speed command 63 and determine the final pump speed command 15, which is employed by the controller 12 to control operation of the electric motor 34. As such, the magnitude of fuel pressure that is delivered to the high-pressure fuel pump 26 can be controlled employing an embodiment of the fuel delivery system 20 described herein with reference to FIG. 1, including characterizing the fuel pump to determine a relationship between fuel pump speed and fuel pump current at an operating point associated with the setpoint pressure of the fuel system pressure relief valve 27, and without need for signal feedback from a fuel pressure sensor. The system described herein reduces hardware complexity by eliminating a fuel pressure sensor without adding other hardware to compensate for the eliminated fuel pressure sensor.

The flowchart and block diagrams in the flow diagrams illustrate the architecture, functionality, and operation of possible implementations of systems, methods, and routines according to various embodiments of the present disclosure. In this regard, each block in the flowchart or block diagrams may represent a module, segment, or portion of code, which comprises one or more executable instructions for implementing the specified logical function(s). It will also be noted that each block of the block diagrams and/or flowchart illustrations, and combinations of blocks in the block diagrams and/or flowchart illustrations, may be implemented by employing an ASIC that performs the specified functions or acts, or combinations of an ASIC and routines. These routines may also be stored in a computer-readable medium that can direct the controller 12 or another programmable data processing apparatus to function in a particular manner, such that the instructions stored in the computer-readable medium produce an article of manufacture including instructions to implement the function/act specified in the flowchart and/or block diagram block or blocks.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

The invention claimed is:

1. A fuel system for an internal combustion engine, comprising:

a fuel delivery system including a first fuel pump that is fluidly coupled to a pressure relief valve that is fluidly disposed in parallel with a second fuel pump; wherein the first fuel pump is disposed to deliver pressurized fuel to the second fuel pump in parallel with the pressure relief valve, and wherein the second fuel pump is disposed to deliver pressurized fuel to a fuel rail; and a controller, operatively connected to the first fuel pump and in communication with the internal combustion engine, the controller including an instruction set, the instruction set being executable to:

characterize the first fuel pump to determine a relationship between a fuel pump speed and a fuel pump current at a setpoint pressure for the pressure relief valve;

determine a target fuel pressure and a fuel flowrate for the first fuel pump;

determine a feed-forward pump speed command for operating the first fuel pump based upon the target fuel pressure and the fuel flowrate;

determine a closed-loop pump speed command for operating the first fuel pump based upon the target fuel pressure, the fuel flowrate and the relationship between fuel pump speed and fuel pump current of the first fuel pump at the setpoint pressure for the pressure relief valve; and control operation of the first fuel pump to deliver fuel to the second fuel pump based upon the feed-forward pump speed command and the closed-loop pump speed command.

2. The fuel system of claim 1, wherein the fuel delivery system is configured to operate absent a fuel pressure sensor.

3. The fuel system of claim 1, wherein the first fuel pump includes a positive-displacement fuel pumping element rotatably coupled to a multi-phase electric motor, and wherein the controller includes a fuel pump controller disposed to control the multi-phase electric motor in response to the feed-forward pump speed command and disposed to determine the closed-loop pump speed command for operating the first fuel pump.

4. The fuel system of claim 3, wherein the fuel pump controller is disposed to determine a magnitude of electric current that is delivered to the electric motor and the fuel pump speed.

5. The fuel system of claim 1, wherein the second fuel pump comprises a high-pressure fuel pump that is fluidly arranged in parallel with the pressure relief valve.

6. The fuel system of claim 1, wherein the instruction set executable to control operation of the first fuel pump to deliver fuel to the high-pressure fuel pump based upon the feed-forward pump speed command and the closed-loop pump speed command comprises the instruction set executable to control the electric motor of the first fuel pump to cause the positive-displacement pumping element to operate at a final pump speed command to controllably deliver fuel to the second fuel pump at the desired pressure.

7. The fuel system of claim 1, further comprising the instruction set being executable to intrusively characterize the first fuel pump to determine a relationship between the fuel pump speed and the fuel pump current at the setpoint pressure of the fuel system pressure relief valve.

8. The fuel system of claim 7, wherein the instruction set being executable to characterize, via the controller, the first fuel pump to determine a relationship between a fuel pump speed and a fuel pump current at the setpoint pressure of the fuel system pressure relief valve comprises the instruction set being executable to:

command an increase in the fuel pump speed and monitor the fuel pump current; and determine a point of inflection in the fuel pump current and an associated fuel pump speed.

9. The fuel system of claim 8, wherein the instruction set being executable to determine a point of inflection in the fuel pump current comprises the instruction set being executable to subject the fuel pump current to dual low pass filtering to detect the point of inflection of the fuel pump current.

10. A fuel system for an internal combustion engine, comprising:

an electrically-powered positive-displacement fuel pump;

a fuel delivery system including the positive-displacement fuel pump fluidly coupled to a pressure relief valve that is arranged in parallel with a high-pressure fuel pump, wherein the high-pressure fuel pump is fluidly coupled to a fuel rail of the internal combustion engine;

the fuel delivery system configured to operate absent a fuel pressure sensor; and a controller, operatively connected to the positive-displacement fuel pump and the internal combustion engine, the controller including an instruction set, the instruction set executable to:

determine a relationship between a fuel pump speed and a fuel pump current for the positive-displacement fuel pump when operating the positive-displacement fuel pump at an operating point associated with a setpoint pressure for the pressure relief valve;

determine a target fuel pressure and a fuel flowrate for the positive-displacement fuel pump;

determine a feed-forward pump speed command for the positive-displacement fuel pump based upon the target fuel pressure and the fuel flowrate;

determine a closed-loop pump speed command based upon the target fuel pressure, the fuel flowrate and the relationship between the fuel pump speed and the fuel pump current; and control operation of the positive-displacement fuel pump to deliver fuel to the second fuel pump based upon the feed-forward pump speed command and the closed-loop pump speed command.

11. The fuel system of claim 10, wherein the positive-displacement fuel pump includes a positive-displacement fuel pumping element rotatably coupled to a multi-phase electric motor, and wherein the controller includes a fuel pump controller disposed to control the multi-phase electric motor in response to the feed-forward pump speed command and the closed-loop pump speed command.

12. The fuel system of claim 11, wherein the fuel pump controller is disposed to determine a magnitude of electric current that is delivered to the multi-phase electric motor and determine the fuel pump speed.

13. The fuel system of claim 11, wherein the instruction set executable to control operation of the positive-displacement fuel pump to deliver fuel to the high-pressure fuel pump based upon the feed-forward pump speed command and the closed-loop pump speed command comprises the instruction set executable to control the positive-displacement fuel pump to cause the positive-displacement pumping element to operate at a final pump speed command to controllably deliver fuel to the high-pressure fuel pump at the desired pressure.

14. The fuel system of claim 10, further comprising the instruction set being executable to intrusively characterize the fuel pump to determine a relationship between the fuel pump speed and the fuel pump current at the setpoint pressure of the fuel system pressure relief valve.

15. The fuel system of claim 14, wherein the instruction set being executable to characterize, via the controller, the positive-displacement fuel pump to determine a relationship between a fuel pump speed and a fuel pump current at the setpoint pressure of the fuel system pressure relief valve comprises the instruction set being executable to:

command an increase in the fuel pump speed and monitor the fuel pump current; and determine a point of inflection in the fuel pump current and an associated fuel pump speed.

16. A method for controlling a fuel delivery system including a first fuel pump that is disposed to supply fuel to a second fuel pump of an internal combustion engine, wherein the fuel delivery system includes the first fuel pump fluidly coupled to a mechanical pressure relief valve fluidly coupled to the second fuel pump, wherein the first fuel pump includes a positive displacement pump element rotatably coupled to an electric motor, the method comprising:

characterizing, via a controller, operation of the first fuel pump to determine a relationship between a fuel pump speed and a fuel pump current at a setpoint pressure for the pressure relief valve;

determining a target fuel pressure and a fuel flowrate;

determining a feed-forward pump speed command based upon the target fuel pressure and the fuel flowrate;

determining a closed-loop pump speed command based upon the target fuel pressure, the fuel flowrate and the characterization of the fuel pump; and controlling the first fuel pump to deliver fuel to the second fuel pump based upon the feed-forward pump speed command and the closed-loop pump speed command.

17. The method of claim 16, wherein characterizing operation of the first fuel pump comprises:

commanding an increase in the fuel pump speed;

monitoring the fuel pump current;

determining a point of inflection in the fuel pump current and an associated fuel pump speed;

correlating the point of inflection in the fuel pump current and the associated fuel pump speed with a setpoint pressure for the pressure relief valve; and determining the relationship between the fuel pump speed and the fuel pump current at the setpoint pressure for the pressure relief valve.

* * * * *